US006424367B1

(12) United States Patent
Obata et al.

(10) Patent No.: US 6,424,367 B1
(45) Date of Patent: Jul. 23, 2002

(54) THICK-FILM THERMAL PRINTHEAD

(75) Inventors: Shinobu Obata; Eiji Yokoyama, both of Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 09/674,728

(22) PCT Filed: Apr. 22, 1999

(86) PCT No.: PCT/JP99/02131

§ 371 (c)(1),
(2), (4) Date: Nov. 6, 2000

(87) PCT Pub. No.: WO99/58341

PCT Pub. Date: Nov. 18, 1999

(30) Foreign Application Priority Data

May 8, 1998 (JP) ..... 10-125957

(51) Int. Cl.[7] ..... B41J 2/335; B41J 2/345
(52) U.S. Cl. ..... 347/208; 347/202
(58) Field of Search ..... 347/200, 208, 347/202

(56) References Cited

U.S. PATENT DOCUMENTS 5,003,324 A * 3/1991 Yoshiike et al. ..... 347/208
5,914,743 A * 6/1999 Tagashira et al. ..... 347/208
5,917,531 A * 6/1999 Nagahata et al. ..... 347/202

FOREIGN PATENT DOCUMENTS

| | | | |
|---|---|---|---|
| JP | 4-128058 A | 4/1992 | ..... B41J/2/345 |
| JP | 05-318793 | 12/1993 | ..... B41J/2/335 |
| JP | 7-304198 | 11/1995 | ..... B41J/2/335 |
| WO | WO97/29915 * | 8/1997 | |

* cited by examiner

*Primary Examiner*—Huan Tran
(74) *Attorney, Agent, or Firm*—Michael D. Bednarek; Shaw Pittman LLP

(57) ABSTRACT

A thick-film thermal printhead comprises: an oblong rectangular substrate (1) having at least one longitudinal edge (1*a*); a partial glaze layer provided on the substrate along the longitudinal edge; a linear heating resistor (11) formed on the partial glaze layer; a common electrode (12) formed on the substrate and electrically connected to the heating resistor; and a plurality of individual electrode (13) formed on the substrate and electrically connected to the heating resistor. The common electrode includes a plurality of comb-like teeth (12A). Each of the comb-like teeth includes a tip portion (12*c*) having a smaller width and a base portion (12*d*) having a larger width. Each of the individual electrodes includes a tip portion (13*d*) having a smaller width and an intermediate portion (13*e*) having a larger width.

10 Claims, 5 Drawing Sheets

THICK-FILM THERMAL PRINTHEAD

This application is the national stage application of international application number PCT/JP99/02131, filed on Apr. 22, 1999.

TECHNICAL FIELD

The present invention relates to a thick-film thermal printhead.

BACKGROUND ART

An example of a conventional thick-film thermal printhead is shown in FIG. 5 and FIG. 6. Each of these conventional thermal printheads (indicated by reference code P) comprises a rectangular head substrate 1' and a print substrate 2', As shown in FIG. 5, the head substrate 1' has a first longitudinal edge 1*a*' and a second longitudinal edge 1*b*' extending in parallel to each other. Further, the head substrate 1' has a first end 1*c*' and a second end 1*d*' extending between the first and the second longitudinal edges. Likewise, the print substrate 2' has two longitudinal edges and two ends.

The head substrate 1' has an upper surface entirely covered by a glaze layer 10' (FIG. 6) made of amorphous glass. On an upper surface of the glaze layer 10', a linear heating resistor 11' extending along the first longitudinal edge 1*a*' is formed. The head substrate 1' is further formed with a common electrode 12' and a plurality of individual electrodes 13'. As shown in FIG. 5, the common electrode 12' extends along the first end 1*c*', the first edge 1*a*', and the second end 1*d*'. Further, the common electrode 12' has a plurality of comb-like teeth 12A' extending in parallel to each other. Each of the comb-like teeth 12A' has a tip potion 12*a*' contacting the heating resistor 11'.

Each of the individual electrodes 13' has a first end portion 13*a*' and a second end portion 13*b*' away therefrom. The first end portion 13*a*' contacts the heating resistor 11' and extends between two adjacent comb-like teeth 12A' On the other hand, the second end portion 13*b*' is formed with a bonding pad 13*c*'. The bonding pad 13*c*' is electrically connected to a drive IC 14' via a connecting wire W'.

With the above constitution, the heating resistor 11' is divided into a plurality of regions 15' by the comb-like teeth 12A'. (FIG. 5 shows only one region 15'.) In each of the regions 15', electric current is passed selectively via the drive IC 14', to heat the selected region 15', making each of the regions 15' function as a heating dot.

The prior-art thick-film thermal printhead P as described above has a following disadvantage: Specifically, the thermal printhead P can provide a good printing result if the printing is performed at a speed of about 2 inches per second (2 ips). However, if the printing speed is increased to about 6 ips for example, printed image can be partially blurred, or an unintended whisker-like projection (feathering) can be printed on a printing sheet.

DISCLOSURE OF THE INVENTION

A thick-film thermal printhead provided by a first aspect of the present invention comprises: an oblong rectangular substrate having at least one longitudinal edge; a partial glaze layer provided on the substrate along the longitudinal edge; a linear heating resistor formed on the partial glaze layer; a common electrode formed on the substrate and electrically connected to the heating resistor; and a plurality of individual electrodes formed on the substrate and electrically connected to the heating resistor.

According to a preferred embodiment, the partial glaze layer has an arcuate cross section. Further, the partial glaze layer has a thickness of 10–25 $\mu$m and a width of 400–1000 $\mu$m.

Preferably, the common electrode includes a plurality of comb-like teeth each including a tip portion having a smaller width and a base portion having a larger width.

The tip portion of each comb-like tooth may be entirely formed on the partial glaze layer. In this case, preferably, the base portion of each comb-like tooth is formed only partially on the partial glaze layer.

Preferably, the base portion of each comb-like tooth is spaced from the heating resistor.

Preferably, the base portion of each comb-like tooth extends on both of the partial glaze layer and the substrate.

According to the preferred embodiment, each of the individual electrodes includes a tip portion having a smaller width for contact with the heating resistor, and an intermediate portion having a larger width.

Preferably, the intermediate portion of each individual electrode is spaced from the heating resistor.

Preferably, the intermediate portion of each individual electrode extends on both of the partial glaze layer and the substrate.

Other object, characteristics and advantages of the present invention will become clearer from an embodiment to be described with reference to the attached drawings.

BRIEF DESCRIPTION OF THE ATTACHED DRAWINGS

BEST MODE FOR CARRYING OUT THE INVENTION

Hereinafter, a preferred embodiment of the present invention will be described with reference to FIG. 1–FIG. 4.

Figure 1:
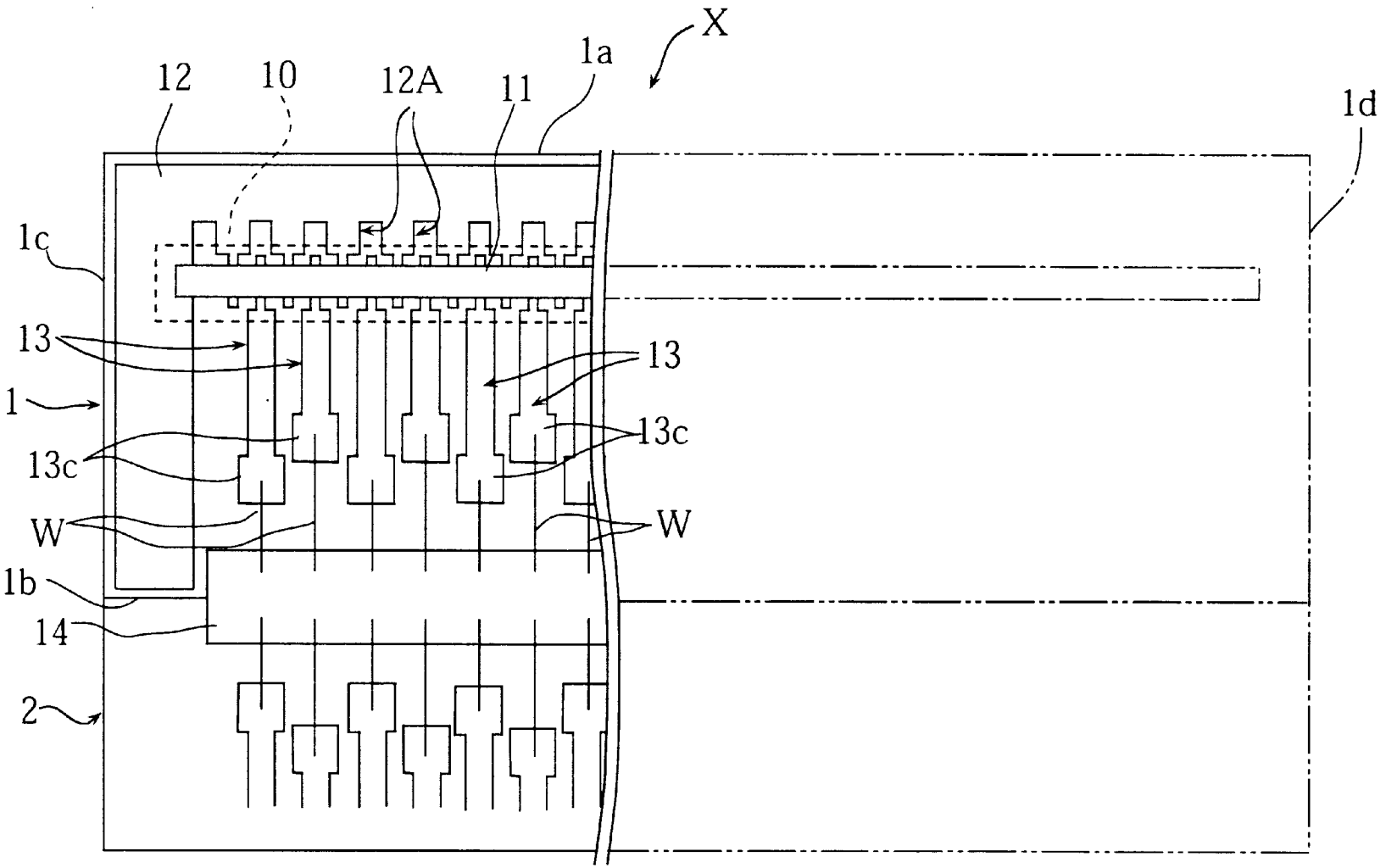
FIG. 1 is a plan view of a thick-film thermal printhead according to the present invention.

FIG. 1 is a plan view showing a thick-film thermal printhead X according to the present invention. As shown in the figure, the thick-film thermal printhead x comprises an oblong rectangular head substrate 1 and an oblong print substrate 2 mounted in adjacency thereto. The head substrate 1 is made of an electrically insulating material such as alumina ceramic whereas the print substrate 2 is made of an electrically insulating material such as glass epoxy resin.

As shown in FIG. 1, the head substrate 1 has a first longitudinal edge 1*a* and a second longitudinal edge 1*b* extending in parallel to each other. Further, the head substrate 1 has a first end 1*c* and a second end 1*d* extending between the first and the second longitudinal edges. Likewise, the print substrate 2 has two longitudinal edges and two ends.

The head substrate 1 has an upper surface formed with a partial, linear glaze layer 10 made of amorphous glass. The partial glaze layer 10 extends in parallel to the first longitudinal edge 1*a* (and the second longitudinal edge 1*b*), closer to the first longitudinal edge 1*a* than to the second longitudinal edge 1*b*. The partial glaze layer 10 has a thickness D1 (FIG. 3) of 10–25 μm, and a with D2 of 400–1000 μm. Advantages achieved from such an arrangement as this will be described later.

Figure 3:
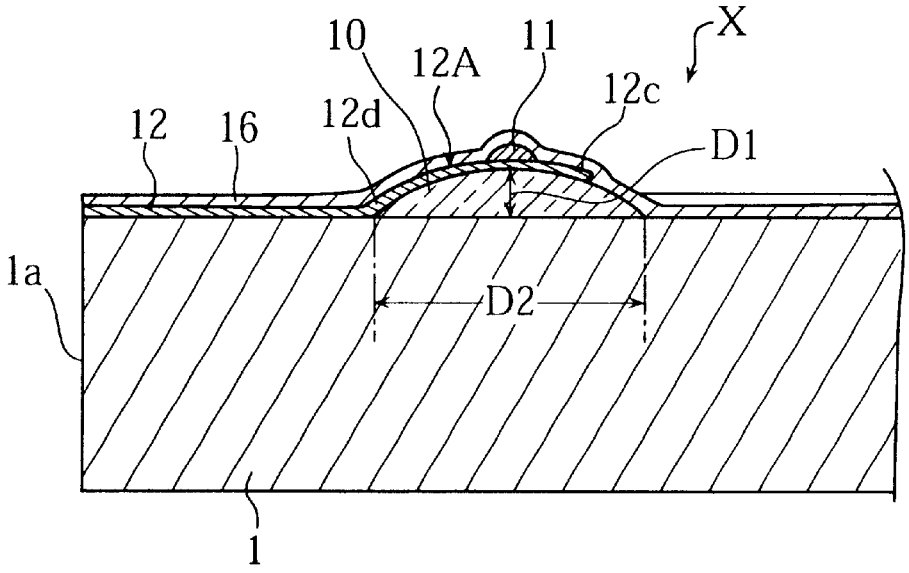
FIG. 3 is a sectional view taken in lines III—III in FIG. 2.

The partial glaze layer 10 can be formed by applying an amorphous glass paste on the head substrate 1 and then baking the same. As shown in FIG. 3, the partial graze layer 10 has a smooth arcuate upper surface. This is because the applied glass paste flows at the time of baking. Along a peak portion of the partial glaze layer 10, a linear heating resistor 11 is formed.

The head substrate 1 is further formed with a common electrode 12 and a plurality of individual electrodes 13. As is clear from FIG. 1, the common electrode 12 extends along the first end 1*c*, the first edge 1*a*, and the second end 1*d*. Further, the common electrode 12 has a plurality of comb-like teeth 12A extending in parallel to each other. Each of the comb-like teeth 12A contacts the heating resistor 11.

Each of the individual electrodes 13 has a first end portion 13*a* and a second end portion 13*b* away therefrom. The first end portion contacts the heating resistor 11 and extends between two adjacent comb-like teeth 12A. On the other hand, the second end portion is formed with a bonding pad 13*c*. The bonding pad 13*c* is electrically connected to a drive IC 14 via a connecting wire W.

Figure 2:
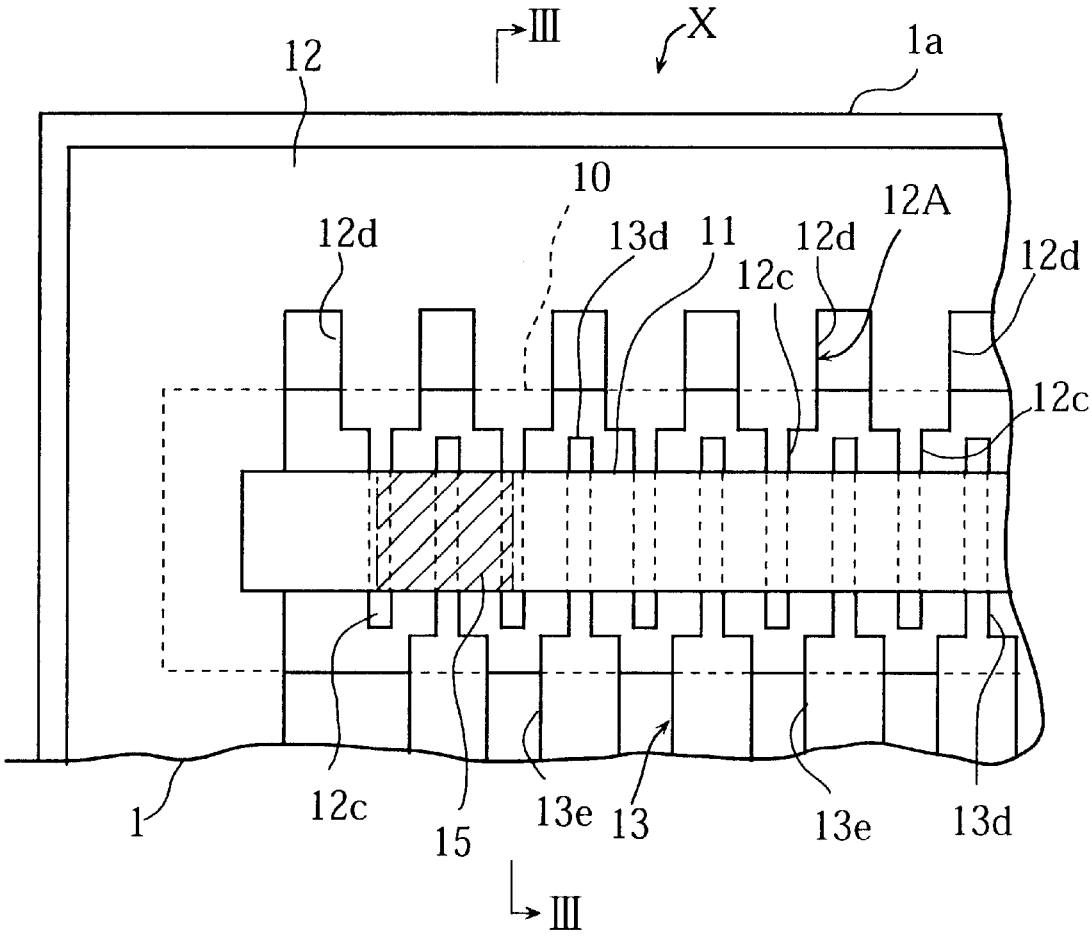
FIG. 2 is a plan view of a primary portion of the thick-film thermal printhead in FIG. 1.

As shown in FIG. 2, each of the comb-like teeth 12A includes a tip portion 12*c* having a smaller width, and a base portion 12*d* having a larger width. The tip portion 12*c* is entirely formed on the partial glaze layer 10, and electrically contacts to the heating resistor 11. On the other hand, the base portion 12*d* is spaced from the heating resistor 11, and only a part of the base portion is formed on the partial glaze layer 10. The other portion of the base portion 12*d* is formed on the head substrate 1. The width of the tip portion 12*c* is 20–25 μm for example, whereas the width of the base portion 12*d* is 80 μm for example. The tip portion 12*c* has a length of 400 μm for example.

Likewise, the first end portion of each of the individual electrodes 13 includes a tip portion 13*d* having a smaller width, and an intermediate portion 13*e* having a larger width. The tip portion 13*d* is entirely formed on the partial glaze layer 10, and electrically contacts to the heating resistor 11. On the other hand, the intermediate portion 13*e* is spaced from the heating resistor 11, and only a part of the intermediate portion is formed on the partial glaze layer 10. The other portion of the intermediate portion 13*e* is formed on the head substrate. The width of the tip portion 13*d* is 20–25 μm for example, whereas the width of the intermediate portion 13*e* is 80 μm for example. The tip portion 13*d* has a length of 400 μm for example.

With the above structure, the heating resistor 11 is divided into a plurality of regions 15 by the comb-like teeth 12A. (FIG. 2 shows only one region 15.) In each of the regions 15, electric current is passed selectively via the drive IC 14, to heat the selected region 15, making each of the regions 15 function as a heating dot. The number of the heating dots is varied in accordance with conditions such as the size of recording paper to be used. For example, if printing is to be made to an A-4 size recording paper at a printing density of 200 dpi, 1728 heating dots are formed in a direction of secondary scanning.

The common electrode 12 and each of the individual electrodes 13 can be formed by using the following method: Specifically, first, a paste containing an electrically conductive metal such as gold is prepared. Next, the paste is applied on the head substrate 1, and then baked. Then, finally, the baked material is etched by means of photolithography into a predetermined pattern. According to such a method as above, the common electrode 12 and the individual electrodes 13 can be formed simultaneously. The common electrode 12 and the individual electrodes 13 have a thickness of about 0.6 μm.

The heating element 11 can be formed by first applying a resistor pate containing ruthenium oxide on the partial glaze layer 10, and then baking the applied paste. The heating resistor 11 has a thickness of about 9 μm for example.

As shown in FIG. 3, a protective coating 16 is formed to cover the heating resistor 11, the common electrode 12 and each of the individual electrodes 13. However, the bonding pads 13*c* of the individual electrodes 13 are not covered by the protective coating 16. The protective coating 16 can be formed by applying a glass paste on the head substrate 1 and then baking the glass paste. The protective coating 16 has a thickness of 4–8 μm for example.

Alternatively, the protective coating 16 can be formed by an electrically conductive material such as Ti-sialon and SiC to a thickness of 4–8 μm. In this case, the formation of the protective coating 16 is performed by using such a technique as sputtering and chemical vapor deposition (CVD) method.

As has been described earlier, in the thick-film thermal printhead according to the present invention, the heating resistor 11 is formed on the partial glaze layer 10. Therefore, it becomes possible to make the heating resistor 11 appropriately contact the recording paper.

The thickness D1 of the partial glaze layer 10 is 10–25 μm, whereas the width D2 is 400–1000 μm. By making the partial glaze layer 10 into the above given dimensions, thermal responsiveness of the heating resistor 11 can be improved over that of the prior art. This point will be described specifically hereafter.

Generally, the thermal responsiveness of the heating resistor 11 decreases to deteriorate printing quality when the area of cross section of the partial glaze layer 10 increases. On the contrary, if the area of cross section of the partial glaze layer 10 is too small, the heating resistor 11 does not properly contact the recording paper. The inventor of the present invention has found that these problems can be eliminated by setting the thickness and the width of the partial glaze layer 10 to the values given above. The inventors of the present invention conducted experiments, with results shown in the table below. (The experiments were made with thermal printhead each having a printing density of 200 dpi, and printing was performed at a speed of 6 ips. The common electrode and the individual electrodes of each thermal printhead were formed by using gold to a thickness of 0.6 μm. The heating resistor was made from a resistor paste containing ruthenium oxide to a thickness of 9 μm.)

| | Glaze Type | Thickness [μm] | Width [μm] | Thermal Response Time (t:msec) | Printing Quality |
|---|---|---|---|---|---|
| Example 1 | Partial Glaze | 12 | 400 | 0.63 | Good<br>No blur<br>No feathering |

-continued

| | Glaze Type | Thick-ness [μm] | Width [μm] | Thermal Response Time (t:msec) | Printing Quality |
|---|---|---|---|---|---|
| Example 2 | Partial Glaze | 24 | 800 | 0.85 | Good No blur No feathering |
| Example 3 | Partial Glaze | 50 | 800 | 1.20 | No good Some blur & Feathering |
| Example 4 | Entire Glaze | 10 | — | 0.56 | No Good some blur & Feathering |

Figure 4:
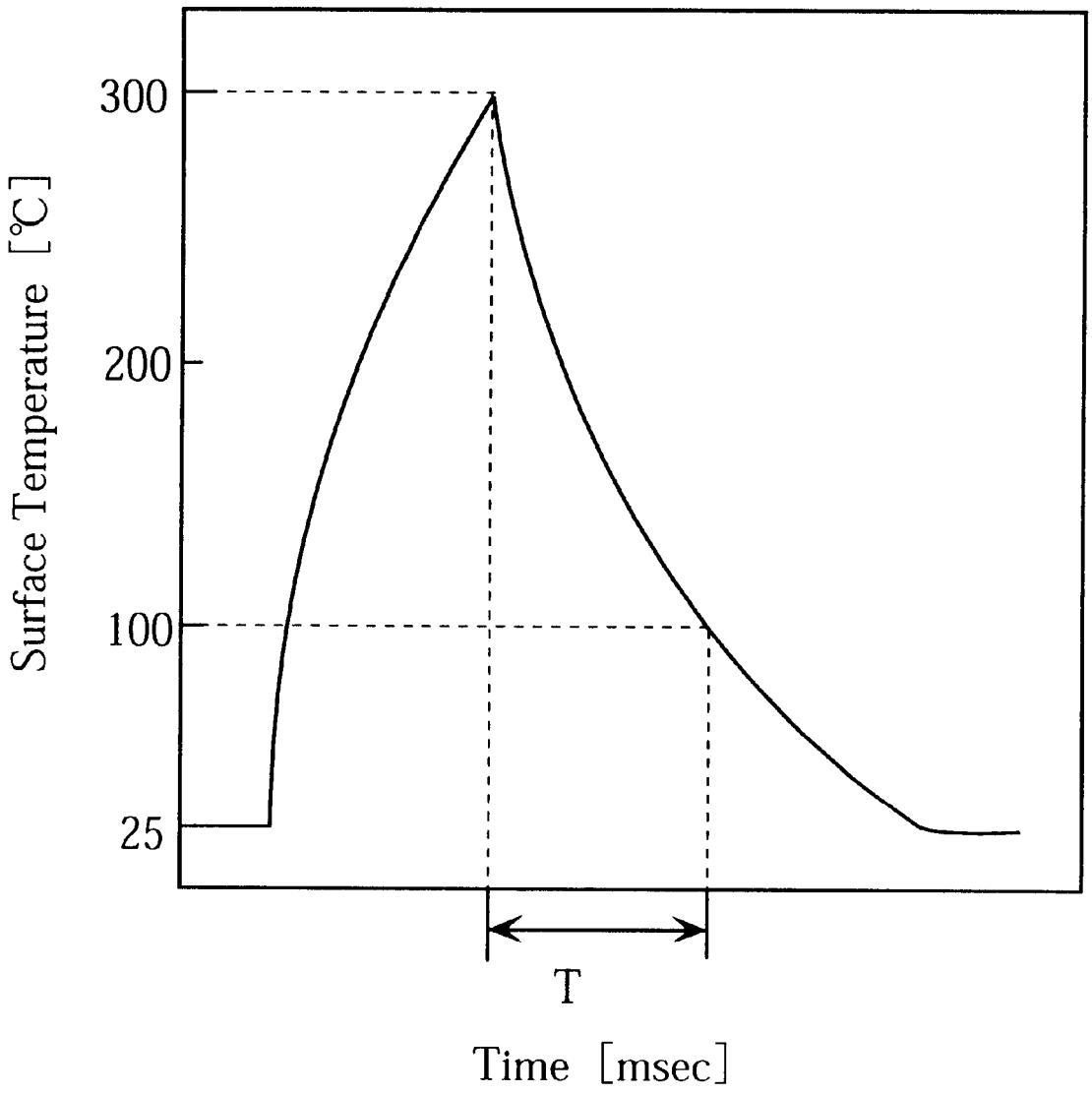
FIG. 4 is a graph showing a thermal response characteristic of a heating dot.
Figure 5:
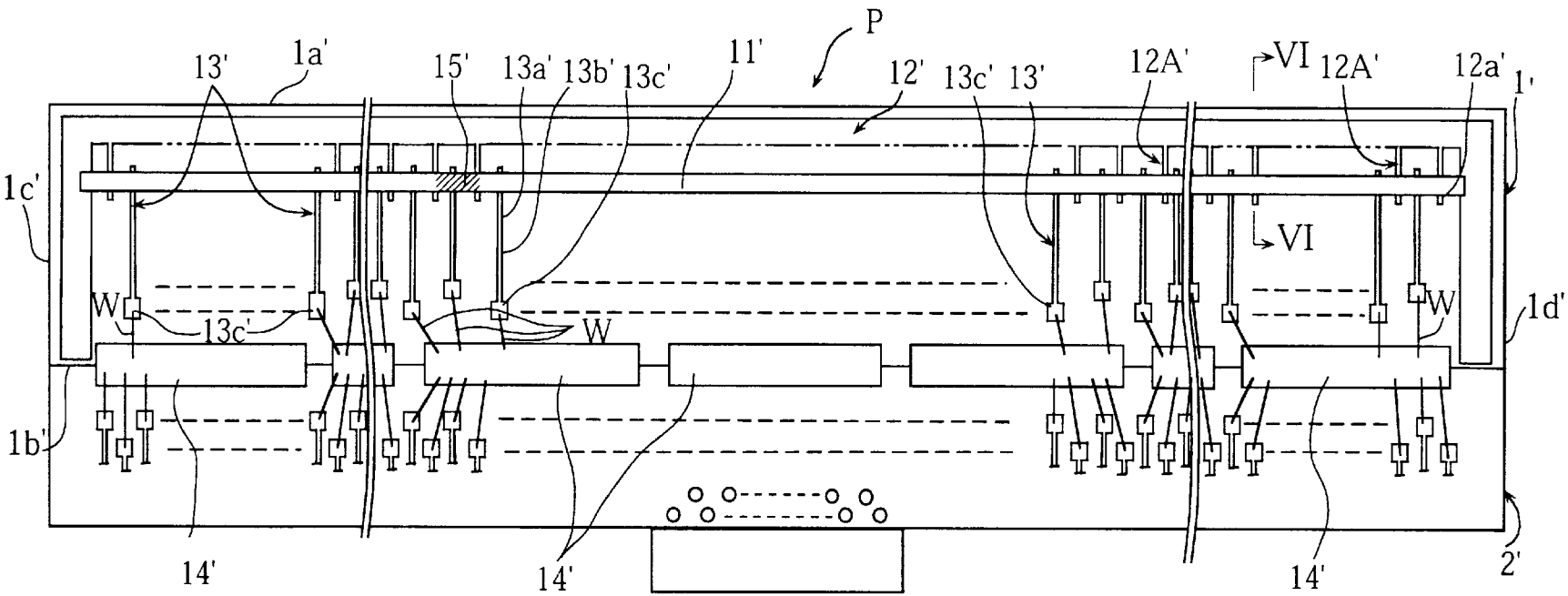
FIG.5 Prior Art
FIG. 5 is a plan view of a prior art thick-film thermal printhead.
Figure 6:
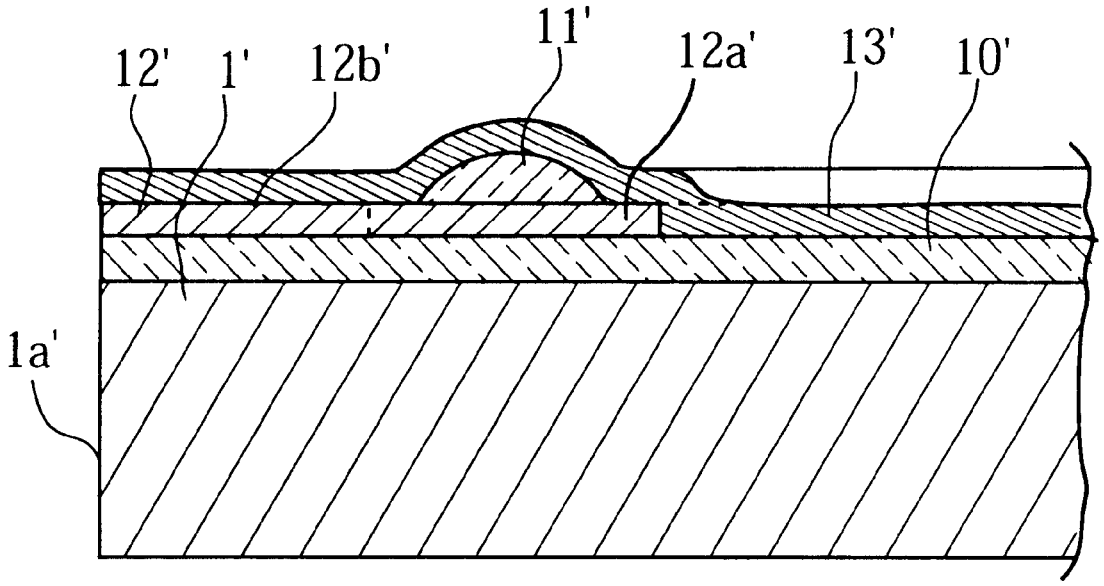
FIG.6 Prior Art
FIG. 6 is a sectional view taken in lines VI—VI in FIG. 5.

As understood from the Table, the thermal responsiveness of the heating resistor increases if the thickness of the partial glaze layer is 10–25 μm and the width thereof is 400–1000 μm, and as a result, good printing image is obtained. It should be noted here that, as shown in FIG. 4, the thermal responsiveness of the heating resistor is evaluated on the basis of time T which is the time necessary for a surface temperature of the heating resistor to descent from 300° C. to 100° C. Specifically, the shorter is the time T, better is the thermal responsiveness.

The thick-film thermal printhead according to the present invention further has the following advantages: Specifically, as has been described with reference to FIG. 2, each of the comb-like teeth 12A and the individual electrodes 13 contacts the heating resistor 11 via the corresponding tip portion 12*c* or 13*d* which has the smaller width. According to such an arrangement as this, the area of each heating dot 15 can be increased than in the prior art, without decreasing the density of the heating dots 15.

Further, according to the present invention, rupture of each comb-like tooth 12A (or the individual electrode 13) can be effectively eliminated. Specifically, there is a step between the head substrate 1 and the partial glaze layer 10, and therefore the comb-like tooth 12A is formed as folded on the head substrate 1 and the partial glaze layer 10 (FIG. 3). Because stress concentrates onto such a folded portion as above, the folded portion is relatively easily ruptured. However, according to the present invention, the folded portion is the wider base portion 12*d*. Therefore, even with the stress concentration, the comb-like tooth 12A is not ruptured easily, and this also applies to each of the individual electrodes.

What is claimed is:

1. A thick-film thermal printhead comprising:

an oblong rectangular substrate (1) having at least one longitudinal edge (1*a*);

a partial glaze layer provided on the substrate along the longitudinal edge;

a linear heating resistor (11) formed on the partial glaze layer;

a common electrode (12) formed on the substrate and electrically connected to the heating resistor; and a plurality of individual electrodes (13) formed on the substrate and electrically connected to the heating resistor;

wherein the common electrode has a plurality of comb-like teeth (12A) contacting the heating resistor, each of the comb-like teeth including a tip portion (12*c*) having a smaller width and a base portion (12*d*) having a larger width, and wherein the larger-width base portion of each comb-like tooth extends on both of the partial glaze layer and the substrate while crossing a longitudinal edge of the partial glaze layer.

2. The thick-film thermal printhead according to claim 1, wherein the partial glaze layer has an arcuate cross section.

3. The thick-film thermal printhead according to claim 1, wherein the partial glaze layer has a thickness of 10–25 μm and a width of 400–1000 μm.

4. The thick-film thermal printhead according to claim 1, wherein the base portion of each comb-like tooth is spaced from the heating resistor.

5. A thick-film thermal printhead comprising:

an oblong rectangular substrate (1) having at least one longitudinal edge (1*a*);

a partial glaze layer provided on the substrate along the longitudinal edge;

a linear heating resistor (11) formed on the partial glaze layer;

a common electrode (12)formed on the substrate and electrically connected to the heating resistor; and a plurality of individual electrodes (13) formed on the substrate and electrically connected to the heating resistor;

wherein the common electrode has a plurality of comb-like teeth (12A) contacting the heating resistor, each of the comb-like teeth including a tip portion (12*c*) having a smaller width and a base portion (12*d*) having a larger width, and wherein the smaller-width tip portion of each comb-like tooth is entirely formed on the partial glaze layer and does not cross a longitudinal edge of the partial glaze layer.

6. A thick-film thermal printhead comprising:

an oblong rectangular substrate (1) having at least one longitudinal edge (1*a*);

a partial glaze layer provided on the substrate along the longitudinal edge;

a linear heating resistor (11) formed on the partial glaze layer;

a common electrode (12)formed on the substrate and electrically connected to the heating resistor; and a plurality of individual electrodes (13) formed on the substrate and electrically connected to the heating resistor;

wherein the common electrode has a plurality of comb-like teeth (12A) contacting the heating resistor, each of the comb-like teeth including a tip portion (12*c*) having a smaller width and a base portion (12*d*) having a larger width, and wherein the larger-width base portion of each comb-like tooth is formed only partially on the partial glaze layer and crosses a longitudinal edge of the partial glaze layer.

7. A thick-film thermal printhead comprising:

an oblong rectangular substrate (1) having at least one longitudinal edge (1*a*);

a partial glaze layer provided on the substrate along the longitudinal edge;

a linear heating resistor (11) formed on the partial glaze layer;

a common electrode (12)formed on the substrate and electrically connected to the heating resistor; and a plurality of individual electrodes (13) formed on the substrate and electrically connected to the heating resistor;

wherein each of the individual electrodes includes a tip portion (13*d*) having a smaller width and an intermediate portion (13*e*) having a larger width, and wherein the intermediate portion of each individual electrode extends on both of the partial glaze layer and the substrate while crossing a longitudinal edge of the partial glaze layer.

8. The thick-film thermal printhead according to claim 7, wherein the partial glaze layer has an arcuate cross section.

9. The thick-film thermal printhead according to claim 7, wherein the partial glaze layer has a thickness of 10–25 $\mu$m and a width of 400–1000 $\mu$m.

10. The thick-film thermal printhead according to claim 7, wherein the intermediate portion of each individual electrodes is spaced from the heating resistor.

* * * * *